US007589609B2

(12) United States Patent
Sutoh et al.

(10) Patent No.: US 7,589,609 B2
(45) Date of Patent: Sep. 15, 2009

(54) MULTILAYER INDUCTOR COMPONENT

(75) Inventors: Naoki Sutoh, Tokyo (JP); Takashi Suzuki, Tokyo (JP); Kunio Oda, Tokyo (JP); Yukio Takahashi, Tokyo (JP); Kunihiko Kawasaki, Tokyo (JP); Hiroshi Momoi, Tokyo (JP)

(73) Assignee: TDK Corporation, Tokyo (JP)

( * ) Notice: Subject to any disclaimer, the term of this patent is extended or adjusted under 35 U.S.C. 154(b) by 0 days.

(21) Appl. No.: 12/115,180

(22) Filed: May 5, 2008

(65) Prior Publication Data

US 2008/0296528 A1 Dec. 4, 2008

(30) Foreign Application Priority Data

May 30, 2007 (JP) ..... 2007-143792

(51) Int. Cl.
*H01F 27/24* (2006.01)

(52) U.S. Cl. ..... 336/233

(58) Field of Classification Search ..... 336/65, 336/83, 200, 232–234; 252/62.6
See application file for complete search history.

(56) References Cited

U.S. PATENT DOCUMENTS 6,736,990 B2 * 5/2004 Aoki et al. ..... 252/62.6
7,034,649 B2 * 4/2006 Asakura et al. ..... 336/233

FOREIGN PATENT DOCUMENTS

| | | |
|---|---|---|
| JP | B2-2867196 | 3/1999 |
| JP | A-11-144934 | 5/1999 |
| JP | A-2002-255637 | 9/2002 |
| JP | B2-3421656 | 6/2003 |
| JP | A-2004-342963 | 12/2004 |

* cited by examiner

*Primary Examiner*—Tuyen Nguyen
(74) *Attorney, Agent, or Firm*—Oliff & Berridge, PLC

(57) ABSTRACT

A multilayer inductor component has a multilayer part having a plurality of magnetic layers laminated therein and a conductor part arranged within the multilayer part. The magnetic layers are formed from a ferrite material and an additive. The ferrite material contains $Fe_2O_3$, NiO, CuO, and ZnO. $Fe_2O_3$ is 30 to 45 mol %. NiO is 45 to 58 mol %. CuO is 6 to 10 mol %. ZnO is 0 to 3 mol %. The additive contains CoO. The content of CoO is 0.1 to 2.5 mass % with respect to the ferrite material as a whole. The multilayer inductor component has an impedance peak of 500 Ω or greater at an operating frequency of 1 GHz or higher.

1 Claim, 3 Drawing Sheets

MULTILAYER INDUCTOR COMPONENT

BACKGROUND OF THE INVENTION

1. Field of the Invention

The present invention relates to a multilayer inductor component.

2. Related Background Art

In general, a multilayer inductor component such as chip inductor, chip bead, chip transformer, or LC composite chip comprises a multilayer part in which magnetic layers are laminated, and a conductor part having a coil-like structure arranged within the multilayer part.

As an example of the multilayer inductor component, Japanese Patent No. 3421656 (Japanese Patent Application Laid-Open No. 2002-246217) discloses a chip inductor constituted by a ferrite material containing 25 to 52 mol % of $Fe_2O_3$, 0 to 40 mol % of ZnO, 0 to 20 mol % of CuO, and 1 to 65 mol % of NiO.

SUMMARY OF THE INVENTION

Recently, as electronic devices such as personal computers, cellular phones, and devices related to DSC, LCD, and DVD have been operating at higher frequencies, their noise has also been reaching higher frequencies. Therefore, demands have been increasing for EMC components (noise eliminating components for signal lines) which can acutely raise their impedances in high-frequency bands (e.g., 1 GHz or higher) so as to eliminate noise and can lower the impedances unnecessary for passing signals in low-frequency bands (e.g., 100 MHz or lower). Namely, it has been demanded to extend the frequency characteristic of their impedances to the higher frequency side than that conventionally attainable.

It is an object of the present invention to provide a multilayer inductor component which can eliminate noise in a high-frequency band.

For achieving the above-mentioned object, the inventors conducted various experiments and studies and, as a result, have found that a ferrite material suitable for constructing a magnetic layer which can realize a multilayer inductor component adapted to eliminate noise in the high-frequency band can be obtained by compounding $Fe_2O_3$, NiO, CuO, ZnO, and CoO in predetermined ratios and firing them. By further conducting experiments, the inventors have completed the present invention.

Namely, the present invention provides a multilayer inductor component comprising a multilayer part having a plurality of magnetic layers laminated therein and a conductor part arranged within the multilayer part. The magnetic layers are formed from a ferrite material and an additive. The ferrite material contains $Fe_2O_3$, NiO, CuO, and ZnO. $Fe_2O_3$ is 30 to 45 mol %. NiO is 45 to 58 mol %. CuO is 6 to 10 mol %. ZnO is 0 to 3 mol %. The additive contains CoO. The content of CoO is 0.1 to 2.5 mass % (1,000 to 25,000 ppm) with respect to the ferrite material as a whole. The multilayer inductor component has an impedance peak of 500 Ω or greater at an operating frequency of 1 GHz or higher.

In the multilayer inductor component in accordance with the present invention, the magnetic layers have the composition mentioned above, while the impedance peak value in the high-frequency band of 1 GHz or higher is 500 Ω or greater. Namely, the multilayer inductor component in accordance with the present invention can shift the series resonance frequency to the higher frequency side (1 GHz or higher) than that conventionally attainable. As a result, when mounted in electronic devices, the multilayer inductor component in accordance with the present invention can eliminate noise occurring in the high-frequency band.

In the multilayer inductor component in accordance with the present invention, the density (hereinafter referred to as sintered density) of the multilayer part obtained by sintering the ferrite material and additive can be 5.00 g/cm$^3$ or higher. When the sintered density is less than 5.00 g/cm$^3$, problems such as deterioration in insulation resistance IR tend to occur.

The present invention can provide a multilayer inductor component which can eliminate noise in the high-frequency band.

The present invention will become more fully understood from the detailed description given hereinbelow and the accompanying drawings which are given by way of illustration only, and thus are not to be considered as limiting the present invention.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

DESCRIPTION OF THE PREFERRED EMBODIMENTS

In the following, preferred embodiments of the present invention will be explained in detail with reference to the accompanying drawings. In the explanation of the drawings, constituents identical or equivalent to each other will be referred to with the same numerals while omitting their overlapping descriptions.

Figure 1:
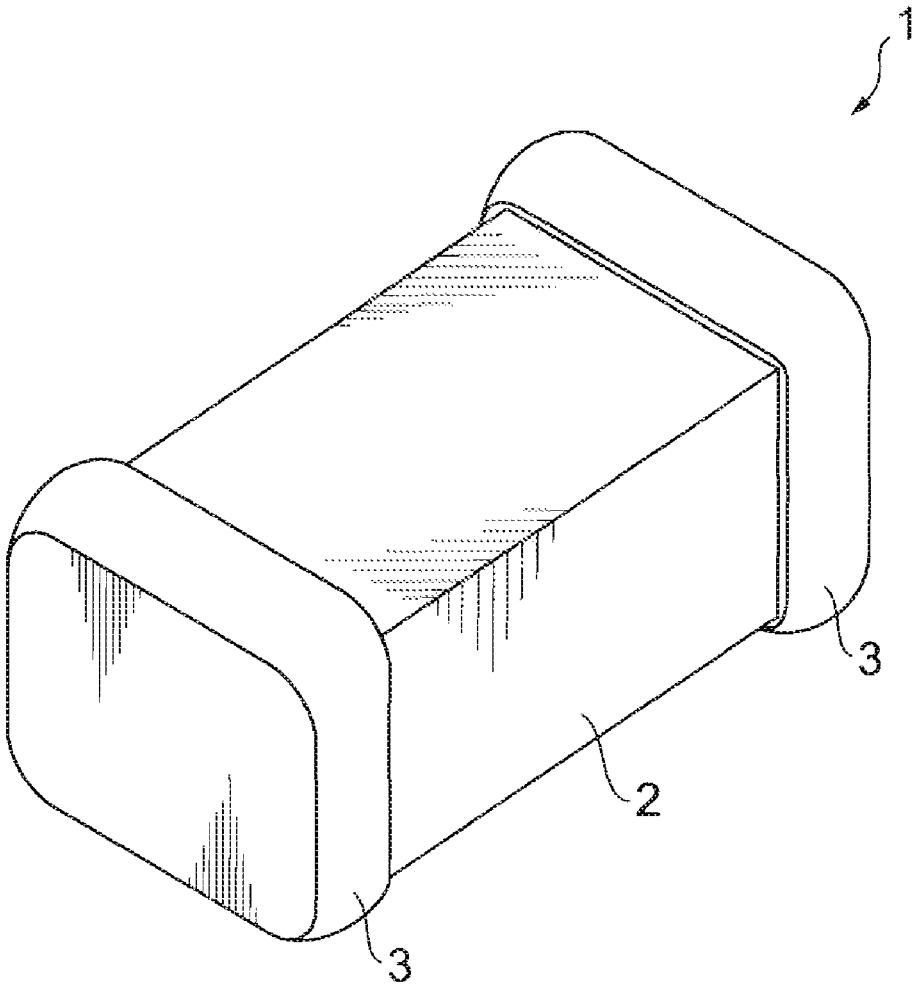
FIG. 1 is a perspective view showing a multilayer chip bead in accordance with an embodiment of the present invention.
Figure 2:
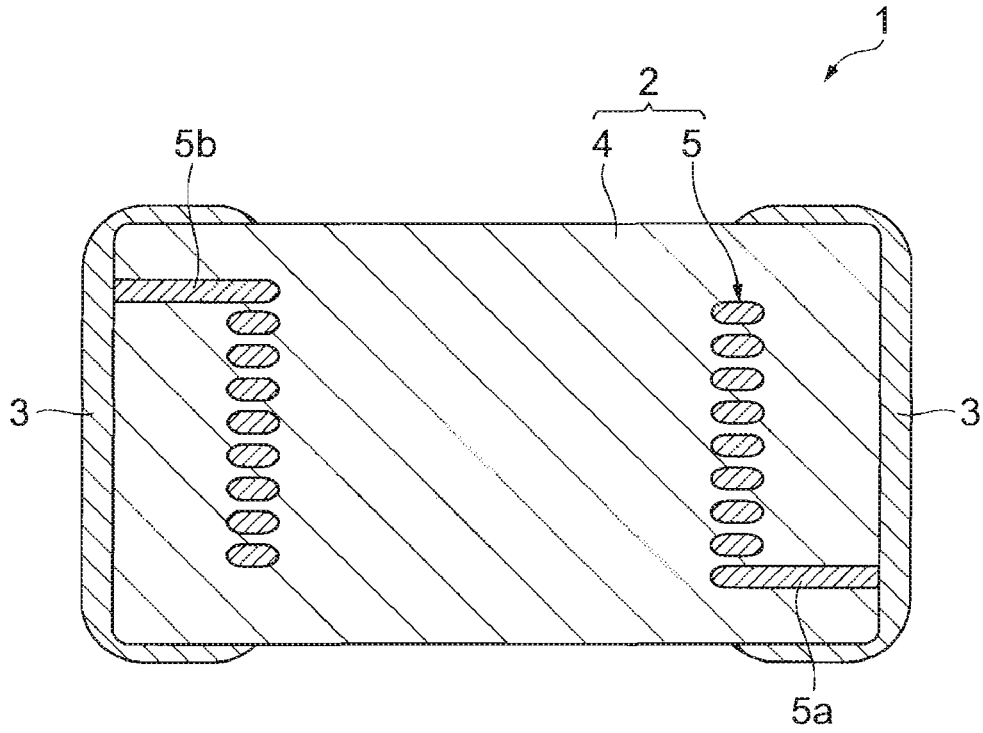
FIG. 2 is a sectional view of the multilayer chip bead taken along a line connecting terminal electrodes thereof shown in FIG. 1.
Figure 3:
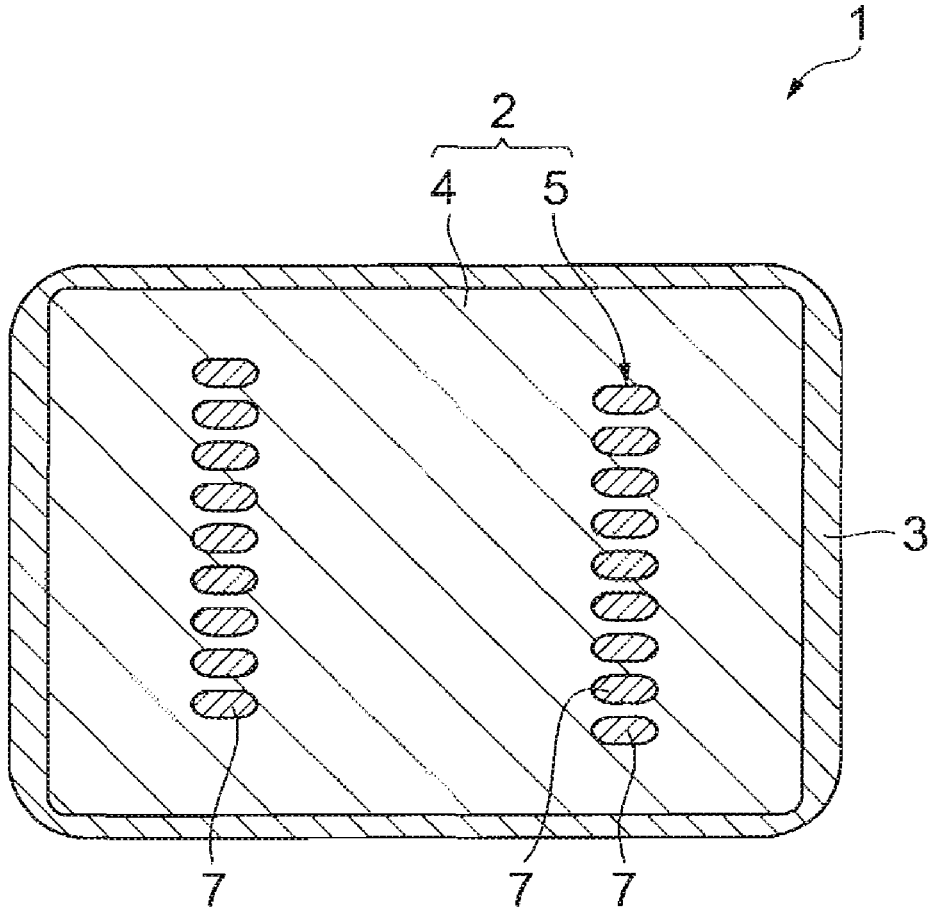
FIG. 3 is a sectional view of the multilayer chip bead taken along a direction orthogonal to the line connecting the terminal electrodes shown in FIG. 1.

FIG. 1 is a perspective view showing a multilayer inductor component (multilayer chip bead) in accordance with an embodiment of the present invention. FIG. 2 is a sectional view of the multilayer chip bead taken along a line connecting terminal electrodes thereof shown in FIG. 1. FIG. 3 is a sectional view of the multilayer chip bead taken along a direction orthogonal to the line connecting the terminal electrodes shown in FIG. 1.

The multilayer chip bead 1 comprises a device 2 having a substantially rectangular parallelepiped form and a pair of terminal electrodes 3, 3. The pair of terminal electrodes 3, 3 are formed on both longitudinal end faces of the device 2, respectively. As shown in FIGS. 2 and 3, the device 2 has a multilayer part 4 and a conductor part wound like a coil (hereinafter referred to as coil-shaped conductor 5). The multilayer part 4 is constructed by laminating magnetic layers formed from a ferrite material and an additive.

The coil-shaped conductor 5 is made of a conductive material and has a substantially semicircular cross section. As shown in FIG. 2, lead portions 5*a*, 5*b* of the coil-shaped conductor 5 are led to edges of the multilayer part 4, so as to be connected to the terminal electrodes 3, 3, respectively. The coil-shaped conductor 5 is constructed by a plurality of conductor patterns 7 in series.

The multilayer chip bead 1 has an impedance peak in a frequency band of 1 GHz or higher, while its peak value is 500 Ω or greater. The number of turns of the coil-shaped conductor 5, which is appropriately determined according to the frequency characteristic of the aimed impedance and the like, is about 8 in this embodiment.

A method of manufacturing the above-mentioned multilayer chip bead 1 will now be explained.

First, a ferrite paste and a conductor paste are made.

The ferrite paste is made by kneading the ferrite material (ferrite powder), the additive, and an organic vehicle. The organic vehicle contains a binder and an organic solvent.

The ferrite powder contains $Fe_2O_3$, NiO, CuO, and ZnO. The content of $Fe_2O_3$ is 30 to 45 mol %, preferably 34 to 40 mol %. The content of NiO is 45 to 58 mol %, preferably 53 to 57 mol %. The content of CuO is 6 to 10 mol %. The content of ZnO is 0 to 3 mol %, preferably 0 to 2 mol %. Of the NiO contained in the ferrite powder, up to 15 mol % can be substituted by MgO.

First, when making the ferrite powder, ferrite raw materials are weighed such that a magnetic layer obtained after firing attains the aimed composition, and then they are wet-mixed with deionized water in a ball mill or the like. Next, the wet-mixed product is dried with a spray dryer or the like and then temporarily fired, so as to yield a temporarily fired powder. Further, the temporarily fired powder is wet-mixed with deionized water in the ball mill or the like, and then the resulting product is dried with a spray dryer or the like, so as to yield the ferrite powder.

The additive contains CoO. The content of CoO is 0.1 to 2.5 mass % (1,000 to 25,000 ppm), preferably 0.2 to 2.0 mass % (2,000 to 20,000 ppm), with respect to the ferrite material as a whole. CoO may be added to the raw materials of the ferrite powder at the time of mixing or to the temporarily fired powder. The additive may further contain MgO and the like in addition to CoO.

The specific surface area of the ferrite powder is preferably 5 to 15 $m^2/g$, more preferably 5 to 10 $m^2/g$ When the specific surface area of the ferrite powder is less than 5 $m^2/g$, sinterability tends to deteriorate greatly. When the specific surface area of the ferrite powder exceeds 15 $m^2/g$, the impedance peak tends to shift toward the lower frequency side because of excess sinterability.

The ferrite powder may contain minute amounts of Mn (2,000 ppm or less in terms of MnO), S (300 to 900 ppm in terms of S atoms), and Cl (100 ppm or less in terms of Cl atoms) in addition to the ingredients mentioned above.

As the binder contained in the organic vehicle, at least one of various kinds of resins such as those based on polyvinyl acetal, ethylcellulose, nitrocellulose, acrylic, phenol, urethane, polyester, rosin, maleic acid, melamine, and urea may be used typically. This embodiment uses a polyvinyl acetal resin and ethylcellulose as the binder. While polyvinyl acetal, polyvinyl butyral, and the like are used as the polyvinyl acetal resin, polyvinyl butyral is preferred.

The content of the binder in the ferrite paste is preferably 3.0 to 5.0 parts by weight with respect to 100 parts by weight of the ferrite powder. The content of the polyvinyl acetal resin in the ferrite paste is preferably 1.0 to 2.0 parts by weight with respect to 100 parts by weight of the ferrite powder. The content of ethylcellulose in the ferrite paste is preferably the remainder of the binder after subtracting the polyvinyl acetal resin content therefrom.

As the organic solvent contained in the organic vehicle, those based on alcohols (ethanol, methanol, propanol, butanol, terpinol, and the like), ketones (acetone and the like), cellosolves (methyl cellosolve, ethyl cellosolve, and the like), esters (methyl acetate, ethyl acetate, and the like), ethers (ethyl ether, butyl carbitol, and the like), and the like may be used either singly or in combinations of two or more.

The above-mentioned ferrite paste may further contain plasticizers such as those based on phthalate esters phosphate esters, fatty acid esters, and glycol derivatives or dispersants such as those based on fatty acid amides, organic phosphate esters, and carboxylic acids.

The conductor paste is made, for example, by compounding a conductor powder with the binder and organic solvent in predetermined ratios and then kneading them. For kneading, a three-roll mill, homogenizer, sand mill, or the like is used.

While Ag, Ag alloys, Cu, Cu alloys, and the like are typically used as the conductor powder, Ag is preferred because of its low resistivity.

Next, the above-mentioned ferrite paste is laminated by printing until a predetermined thickness is obtained. Then, the ferrite paste is further formed on the laminate, so as to yield a ferrite green layer. The ferrite green layer is dried, so as to form a ferrite dry layer. Subsequently, the above-mentioned conductor paste is printed on the ferrite dry layer and dried, so as to form a conductor pattern. On the ferrite dry layer formed with the conductor pattern, a plurality of ferrite dry layers and conductor patterns are alternately laminated by printing. The ferrite paste is further laminated thereon by printing by a predetermined thickness, so as to form a raw multilayer body. This multilayer body corresponds to the device 2 in the completed multilayer chip bead (see FIG. 1). In the device 2, a spiral multilayer coil (coil-shaped conductor 5) having a predetermined number of turns (number of windings) is formed in the ferrite magnetic body (multilayer part 4 having a plurality of magnetic layers laminated therein). The ferrite green layers (ferrite dry layers) become magnetic layers in the device 2.

Next, the multilayer body is cut into predetermined sizes. Since the multilayer body usually has a wafer structure in which a plurality of device units are arranged, cutting the wafer-shaped multilayer body into the predetermined sizes yields a plurality of raw multilayer devices each incorporating one coil-shaped conductor 5 therein. Here, the wafer-shaped multilayer body is cut such that end faces of the lead parts 5*a*, 5*a* of the coil-shaped conductor 5 are exposed from two opposing side faces of the multilayer device, respectively.

Thereafter, thus obtained multilayer device is subjected to a debindering process in the presence of oxygen at 350 to 500° C., for example. Subsequently, the multilayer device is integrally fired at 850 to 920° C. for 1 to 2 hr, for example, so as to sinter the multilayer part 4 and conductor patterns 7, thereby yielding the above-mentioned device 2.

Next, in the device 2 obtained by firing, a conductive paste mainly composed of Ag is applied to the side faces where the lead parts 5*a*, 5*b* of the coil-shaped conductor 5 are exposed and is burned thereon at about 600° C., for example, so as to form the terminal electrodes 3, 3. Thereafter, the terminal electrodes 3, 3 are usually subjected to electroplating. Preferably, the electroplating is performed by using a combination of copper, nickel, and tin, nickel and tin, nickel and gold, nickel and silver, or the like.

The foregoing completes the multilayer chip bead 1 in accordance with this embodiment.

In the multilayer chip bead 1 in accordance with the above-mentioned embodiment, the magnetic layers are formed from the ferrite material and additive, the ferrite material contains $Fe_2O_3$, NiO, CuO, and ZnO, the content of $Fe_2O_3$ is 30 to 45 mol %, the content of NiO is 45 to 58 mol %, the content of CuO is 6 to 10 mol %, the content of ZnO is 0 to 3 mol %, the additive contains CoO, the content of CoO is 0.1 to 2.5 mass % (1,000 to 25,000 ppm) with respect to the ferrite material as a whole, and the impedance peak in the high-frequency band of 1 GHz or higher is 500 Ω or greater. Namely, this embodiment can shift the series resonance frequency of the multilayer chip bead 1 to the higher frequency side than that conventionally attainable. As a result, when mounted in electronic devices, the multilayer chip bead 1 in accordance with this embodiment can eliminate noise occurring in the high-frequency band.

In the above-mentioned embodiment, the multilayer part 4 obtained by sintering the ferrite material and additive can attain a sintered density of 5.00 g/cm$^3$ or higher. When the sintered density is less than 5.00 g/cm$^3$, problems such as deterioration in insulation resistance IR tend to occur.

In the above-mentioned embodiment, the ferrite paste contains not only ethylcellulose which has conventionally been used, but also the polyvinyl acetal resin having a softness higher than that of ethylcellulose, as the binder. Therefore, the softness of the ferrite green layer becomes higher than that conventionally attainable. As a result, even when a contraction stress is generated in the ferrite green layer in the step of drying the same, cracks are restrained from occurring therein. Even when the progress of drying varies depending on differences in thickness of the ferrite green layer, the occurrence of cracks in the ferrite green layer can be suppressed. Further, even when the conductor pattern is thick, the occurrence of cracks caused by differences in thickness of the ferrite green layer can be suppressed.

The polyvinyl acetal resin contained as the binder in the ferrite paste in accordance with the above-mentioned embodiment has a pyrolysis temperature range higher than that of ethylcellulose. Therefore, the polyvinyl acetal resin is hard to decompose in the temperature range where the conductor patterns 7 contract in the heat treatment steps of the multilayer body (debindering and firing steps), so that the ratio of the binder remaining in the ferrite dry layer becomes higher than that conventionally attainable, whereby the ferrite dry layer improves its shape retention. As a result, the occurrence of cracks is suppressed in the ferrite dry layer (magnetic layer).

The following tendencies occur when the content of the polyvinyl acetal resin in the ferrite paste is less than 1.0 part by weight with respect to 100 parts by weight of the ferrite powder. Since the softness of the ferrite green layer becomes lower, cracks are likely to occur in the ferrite green layer when the latter is dried. At the time of firing the multilayer body, the ratio of the binder remaining in the ferrite dry layer decreases in the temperature range where the conductor patterns 7 contract, whereby cracks are likely to occur in the ferrite green layer (magnetic layer).

When the content of the polyvinyl acetal resin is greater than 2.0 parts by weight with respect to 100 parts by weight of the ferrite powder, the remaining ratio of the binder in the ferrite dry layer becomes in excess in the temperature range where the conductor patterns 7 contract at the time of firing the multilayer body. Therefore, the remaining binder burns drastically in the firing temperature range after debindering, whereby cracks are likely to occur in the ferrite dry layer in the part in close contact with the conductor patterns 7. Hence, the content of the polyvinyl acetal resin is 1.0 to 2.0 parts by weight with respect to 100 parts by weight of the ferrite powder in this embodiment, whereby the occurrence of cracks is suppressed in the ferrite green layer (ferrite dry layer).

In the multilayer chip bead 1, the coil-shaped conductor 5 has a substantially semicircular cross section, whereby a thickness can be secured by a smaller amount of conductor paste than that in the case of a rectangular cross section. When the thickness of the conductor patterns 7 (coil-shaped conductor 5) is thus increased, the shrinkage ratio at the time of firing becomes greater. Therefore, at the time of firing, the difference between the shrinkage ratio of the conductor patterns 7 and that of the multilayer part 4 becomes smaller. Hence, the difference between the amount of shrinkage of the multilayer part 4 and that of the conductor patterns 7 at the time of firing is reduced, whereby the occurrence of cracks in the portion of the multilayer part 4 in close contact with the conductor patterns 7 is suppressed.

Though a preferred embodiment of the present invention is explained in detail in the foregoing, the present invention is not limited to the above-mentioned embodiment. For example, the present invention is applicable to multilayer inductor components such as chip inductors, chip transformers, and LC composite chip components as well as chip beads.

The present invention will now be explained in detail with reference to examples, which do not restrict the present invention at all.

EXAMPLE 1

Making of Multilayer Chip Bead

In the following manner, the multilayer chip bead of Example 1 was made according to the above-mentioned manufacturing method.

First, in the making of the multilayer chip bead, a mixed powder of a ferrite powder and an additive was prepared. In the making of the ferrite powder, 30.0 mol % of $Fe_2O_3$, 58.0 mol % of NiO, 9.0 mol % of CuO, and 3.0% of Zn were weighed, so as to yield a raw material powder. The raw material powder with 0.1 mass % (1,000 ppm) of CoO as an additive added thereto was wet-mixed with deionized water in a ball mill and then dried with a spray dryer, whereby a mixed powder was obtained. Subsequently, the mixed powder was temporarily fired at 700 to 800° C. for 10 hr, so as to yield a temporarily fired powder. Thereafter, the temporarily fired powder was wet-mixed with deionized water in a ball mill and then pulverized until particles having an average particle size of 0.7 μm with a specific surface area on the order of 5 to 10 m$^2$/g were obtained. The particles obtained by pulverization were dried with the spray dryer, so as to yield the mixed powder of the ferrite powder and additive.

Next, the resulting mixed powder of the ferrite powder and additive was wet-mixed with an organic vehicle in a ball mill, so as to make a ferrite paste.

On the other hand, a conductor paste was made. The conductor paste was made by compounding an Ag powder having an average particle size of 0.6 μm with a binder and a solvent in predetermined ratios and then kneading them.

Next, the ferrite paste was laminated by printing until a predetermined thickness was obtained. Then, on this laminate, a plurality of layers of the ferrite paste and conductor paste were alternately laminated by printing. The ferrite paste was further laminated thereon by printing by a predetermined thickness, so as to form a raw multilayer body incorporating therewithin a plurality of multilayer coils (precursors of coil-shaped conductors 5) each having 8 turns. Subsequently, this multilayer body was cut, such as to yield a multilayer device having one precursor of the coil-shaped conductor 5 arranged therewithin.

Thus obtained multilayer device was subjected to a debindering process in the presence of oxygen at 500° C. After the debindering process, the multilayer device was fired at 900° C. for 2 hr, so as to yield the device 2 having the multilayer part 4 and the coil-shaped conductor 5 arranged therewithin. A conductor paste mainly composed of Ag was applied to and burned at about 600° C. onto each side face of the device 2 where an end face of a lead part of the coil-shaped conductor 5 was exposed. Further, the burned surface of Ag was electroplated with Cu, Ni, and Sn, so as to form the terminal electrode 3. The foregoing yielded the multilayer chip bead 1 of Example 1. Thus obtained multilayer chip bead 1 had a 1005 type (1.0×0.5×0.5 mm). The magnetic layer (multilayer part 4) in the completed multilayer chip bead 1 had a composition identical to the specific composition of the ferrite powder that is a raw material of the magnetic layer (multilayer part 4). The content of CoO in the magnetic layer (multilayer part 4) was identical to that of CoO in the additive added to the ferrite powder.

EXAMPLES 2 TO 15 AND COMPARATIVE EXAMPLES 1 TO 14 AND 16 TO 31

The multilayer chip beads of Examples 2 to 15 and Comparative Examples 1 to 14 and 16 to 31 were made by the same method as that of Example 1 except that ferrite powders having respective compositions shown in Tables 1 to 4 were used.

Evaluation

Measurement of Sintered Density

The density of the multilayer part 4 after firing (hereinafter referred to as sintered density) was measured in each of Examples 1 to 15 and Comparative Examples 1 to 14 and 16 to 31. Tables 1 to 4 show the results. The sintered density is preferably 5.00 g/cm$^3$ or higher.

Measurement of Impedance

For each of the multilayer chip beads of Examples 1 to 15 and Comparative Examples 1 to 14 and 16 to 31, the series resonance frequency fr, the impedance peak value frZ at the series resonance frequency ft, and the impedance value at a frequency of 100 MHz were measured. As a measuring apparatus, HP-4291B RF Impedance/Material Analyzer manufactured by Hewlett-Packard was used. Tables 1 to 4 show the results.

The series resonance frequency fr is preferably 1 GHz or higher. The impedance peak value frZ at the series resonance frequency fr is preferably 500 Ω or greater. The lower the impedance value at the frequency of 100 MHz, the more preferred it is.

In Tables 1 to 4, each case exhibiting all of the sintered density of 5.00 g/cm$^3$ or higher in the multilayer part 4, the series resonance frequency fr of 1 GHz or higher, and the impedance peak value frZ of 500 Ω or greater at the series resonance frequency fr was determined "o", otherwise "x". The determination is preferably "o".

TABLE 1

| | FERRITE POWDER COMPOSITION | | | | ADDITIVE | | MULTILAYER CHIP BEAD | | | | |
|---|---|---|---|---|---|---|---|---|---|---|---|
| | | | | | | | MULTILAYER PART SINTERED | | IMPEDANCE | | |
| | $Fe_2O_3$ | NiO | CuO | ZnO | CoO | | DENSITY | fr | fr Z | f = 100 MHz | DETER- |
| | (mol %) | (mol %) | (mol %) | (mol %) | (ppm) | (MASS %) | (g/cm$^3$) | (GHz) | (Ω) | (Ω) | MINATION |
| COMPARATIVE EXAMPLE 1 | 27.0 | 60.0 | 10.0 | 3.0 | 0 | 0.0 | 4.95 | 1.90 | 348 | 42 | X |
| COMPARATIVE EXAMPLE 2 | 28.0 | 59.0 | 10.0 | 3.0 | 0 | 0.0 | 4.96 | 1.80 | 375 | 44 | X |
| COMPARATIVE EXAMPLE 3 | 29.0 | 58.0 | 9.0 | 3.0 | 0 | 0.0 | 4.98 | 1.50 | 381 | 46 | X |
| COMPARATIVE EXAMPLE 4 | 30.0 | 56.0 | 11.0 | 3.0 | 0 | 0.0 | 4.98 | 1.40 | 401 | 50 | X |
| COMPARATIVE EXAMPLE 5 | 30.0 | 59.0 | 8.0 | 3.0 | 0 | 0.0 | 4.97 | 1.80 | 438 | 49 | X |
| COMPARATIVE EXAMPLE 6 | 30.0 | 56.0 | 10.0 | 4.0 | 0 | 0.0 | 4.97 | 1.50 | 420 | 51 | X |
| COMPARATIVE EXAMPLE 7 | 30.0 | 56.0 | 10.0 | 4.0 | 1000 | 0.1 | 4.99 | 1.50 | 459 | 55 | X |
| COMPARATIVE EXAMPLE 8 | 30.0 | 56.0 | 10.0 | 4.0 | 2000 | 0.2 | 4.99 | 1.45 | 478 | 53 | X |
| COMPARATIVE EXAMPLE 9 | 30.0 | 56.0 | 10.0 | 4.0 | 3000 | 0.3 | 4.98 | 1.45 | 500 | 50 | X |
| COMPARATIVE EXAMPLE 10 | 30.0 | 56.0 | 10.0 | 4.0 | 4000 | 0.4 | 4.97 | 1.40 | 523 | 46 | X |
| EXAMPLE 15 | 32.0 | 55.0 | 10.0 | 3.0 | 2000 | 0.2 | 5.00 | 1.45 | 502 | 49 | ○ |

TABLE 2

| | FERRITE POWDER COMPOSITION | | | | ADDITIVE | | MULTILAYER CHIP BEAD | | | | |
|---|---|---|---|---|---|---|---|---|---|---|---|
| | | | | | | | MULTILAYER PART SINTERED | | IMPEDANCE | | |
| | $Fe_2O_3$ | NiO | CuO | ZnO | CoO | | DENSITY | fr | fr Z | | |
| | (mol %) | (mol %) | (mol %) | (mol %) | (ppm) | (MASS %) | (g/cm$^3$) | (GHz) | (Ω) | | DETERMINATION |
| COMPARATIVE EXAMPLE 11 | 30.0 | 58.0 | 9.0 | 3.0 | 0 | 0.0 | 4.98 | 1.70 | 460 | 46 | X |
| COMPARATIVE EXAMPLE 12 | 30.0 | 58.0 | 9.0 | 3.0 | 500 | 0.1 | 4.98 | 1.70 | 480 | 53 | X |
| COMPARATIVE EXAMPLE 13 | 30.0 | 58.0 | 9.0 | 3.0 | 800 | 0.1 | 4.99 | 1.65 | 493 | 51 | X |
| COMPARATIVE EXAMPLE 14 | 30.0 | 58.0 | 9.0 | 3.0 | 900 | 0.1 | 4.99 | 1.65 | 496 | 50 | X |
| EXAMPLE 1 | 30.0 | 58.0 | 9.0 | 3.0 | 1000 | 0.1 | 5.00 | 1.65 | 500 | 49 | ○ |
| EXAMPLE 2 | 30.0 | 58.0 | 9.0 | 3.0 | 2000 | 0.2 | 5.00 | 1.60 | 519 | 47 | ○ |
| EXAMPLE 3 | 32.0 | 57.0 | 9.0 | 2.0 | 2000 | 0.2 | 5.01 | 1.65 | 520 | 50 | ○ |
| EXAMPLE 4 | 34.0 | 55.0 | 9.0 | 2.0 | 2000 | 0.2 | 5.03 | 1.60 | 514 | 52 | ○ |
| EXAMPLE 5 | 36.0 | 53.5 | 9.0 | 1.5 | 5000 | 0.5 | 5.06 | 1.55 | 532 | 53 | ○ |
| EXAMPLE 6 | 38.0 | 52.5 | 8.0 | 1.5 | 5000 | 0.5 | 5.08 | 1.50 | 526 | 55 | ○ |
| EXAMPLE 7 | 40.0 | 50.5 | 8.0 | 1.5 | 10000 | 1.0 | 5.09 | 1.40 | 540 | 57 | ○ |
| EXAMPLE 8 | 42.0 | 49.5 | 7.0 | 1.5 | 10000 | 1.0 | 5.11 | 1.35 | 534 | 59 | ○ |
| EXAMPLE 9 | 44.0 | 48.0 | 7.0 | 1.0 | 15000 | 1.5 | 5.12 | 1.25 | 525 | 60 | ○ |
| EXAMPLE 10 | 45.0 | 48.0 | 6.0 | 1.0 | 15000 | 1.5 | 5.16 | 1.20 | 521 | 62 | ○ |

TABLE 3

| | FERRITE POWDER COMPOSITION | | | | ADDITIVE | | MULTILAYER CHIP BEAD | | | | |
|---|---|---|---|---|---|---|---|---|---|---|---|
| | | | | | | | MULTILAYER PART SINTERED | | IMPEDANCE | | |
| | $Fe_2O_3$ | NiO | CuO | ZnO | CoO | | DENSITY | fr | fr Z | f = 100 MHz | DETER- |
| | (mol %) | (mol %) | (mol %) | (mol %) | (ppm) | (MASS %) | (g/cm$^3$) | (GHz) | (Ω) | (Ω) | MINATION |
| EXAMPLE11 | 45.0 | 45.0 | 9.0 | 0.0 | 25000 | 2.5 | 5.10 | 1.2 | 520 | 36 | ○ |
| COMPARATIVE EXAMPLE 16 | 45.0 | 45.0 | 6.0 | 4.0 | 25000 | 2.5 | 5.06 | 0.8 | 451 | 90 | X |
| COMPARATIVE EXAMPLE 17 | 45.0 | 45.0 | 5.8 | 4.2 | 25000 | 2.5 | 5.05 | 0.8 | 453 | 92 | X |
| COMPARATIVE EXAMPLE 18 | 45.0 | 44.0 | 10.0 | 1.0 | 20000 | 2.0 | 5.16 | 1.0 | 495 | 76 | X |
| COMPARATIVE EXAMPLE 19 | 45.0 | 44.0 | 10.0 | 1.0 | 25000 | 2.5 | 5.10 | 0.9 | 517 | 61 | X |
| COMPARATIVE EXAMPLE 20 | 46.0 | 46.0 | 7.0 | 1.0 | 20000 | 2.0 | 5.06 | 1.1 | 492 | 73 | X |
| COMPARATIVE EXAMPLE 21 | 46.0 | 46.0 | 7.0 | 1.0 | 25000 | 2.5 | 5.03 | 0.9 | 513 | 62 | X |

TABLE 4

| | FERRITE POWDER COMPOSITION | | | | ADDITIVE | | MULTILAYER CHIP BEAD | | | | |
|---|---|---|---|---|---|---|---|---|---|---|---|
| | | | | | | | MULTILAYER PART SINTERED | | IMPEDANCE | | |
| | $Fe_2O_3$ | NiO | CuO | ZnO | CoO | | DENSITY | fr | fr Z | f = 100 MHz | DETER- |
| | (mol %) | (mol %) | (mol %) | (mol %) | (ppm) | (MASS %) | (g/cm$^3$) | (GHz) | (Ω) | (Ω) | MINATION |
| COMPARATIVE EXAMPLE 22 | 45.0 | 45.0 | 9.0 | 1.0 | 0 | 0.00 | 5.09 | 1.50 | 400 | 130 | X |
| COMPARATIVE EXAMPLE 23 | 45.0 | 45.0 | 9.0 | 1.0 | 500 | 0.05 | 5.09 | 1.50 | 410 | 122 | X |
| COMPARATIVE EXAMPLE 24 | 45.0 | 45.0 | 9.0 | 1.0 | 1000 | 0.10 | 5.10 | 1.45 | 430 | 117 | X |

TABLE 4-continued

| | FERRITE POWDER COMPOSITION | | | | ADDITIVE | | MULTILAYER CHIP BEAD | | | | |
|---|---|---|---|---|---|---|---|---|---|---|---|
| | | | | | | | MULTILAYER PART SINTERED | IMPEDANCE | | | |
| | $Fe_2O_3$ | NiO | CuO | ZnO | CoO | | DENSITY | fr | fr Z | f = 100 MHz | DETER- |
| | (mol %) | (mol %) | (mol %) | (mol %) | (ppm) | (MASS %) | (g/cm$^3$) | (GHz) | (Ω) | (Ω) | MINATION |
| COMPARATIVE EXAMPLE 25 | 45.0 | 45.0 | 9.0 | 1.0 | 5000 | 0.50 | 5.12 | 1.40 | 459 | 97 | X |
| COMPARATIVE EXAMPLE 26 | 45.0 | 45.0 | 9.0 | 1.0 | 10000 | 1.00 | 5.15 | 1.30 | 483 | 79 | X |
| EXAMPLE 12 | 45.0 | 45.0 | 9.0 | 1.0 | 15000 | 1.50 | 5.18 | 1.20 | 502 | 66 | ○ |
| EXAMPLE 13 | 45.0 | 45.0 | 9.0 | 1.0 | 20000 | 2.00 | 5.14 | 1.10 | 518 | 58 | ○ |
| EXAMPLE 14 | 45.0 | 45.0 | 9.0 | 1.0 | 25000 | 2.50 | 5.08 | 1.00 | 538 | 42 | ○ |
| COMPARATIVE EXAMPLE 27 | 45.0 | 45.0 | 9.0 | 1.0 | 26000 | 2.60 | 5.05 | 0.95 | 544 | 39 | X |
| COMPARATIVE EXAMPLE 28 | 45.0 | 45.0 | 9.0 | 1.0 | 27000 | 2.70 | 5.02 | 0.90 | 550 | 36 | X |
| COMPARATIVE EXAMPLE 29 | 45.0 | 45.0 | 9.0 | 1.0 | 28000 | 2.80 | 4.98 | 0.85 | 555 | 32 | X |
| COMPARATIVE EXAMPLE 30 | 45.0 | 45.0 | 9.0 | 1.0 | 29000 | 2.90 | 4.94 | 0.80 | 559 | 28 | X |
| COMPARATIVE EXAMPLE 31 | 45.0 | 45.0 | 9.0 | 1.0 | 30000 | 3.00 | 4.88 | 0.75 | 563 | 23 | X |

In Examples 1 to 15, as shown in Tables 1 to 4, the ferrite powder (ferrite material) contained $Fe_2O_3$, NiO, CuO, and ZnO, the content of $Fe_2O_3$ was 30 to 45 mol %, the content of NiO was 45 to 58 mol %, the content of CuO was 6 to 10 mol %, the content of ZnO was 0 to 3 mol %, the additive contained CoO, and the content of CuO was 0.1 to 2.5 mass % (1,000 to 25,000 ppm) with respect to the ferrite material as a whole. In Examples 1 to 15, it was verified that the multilayer chip bead 1 had an impedance peak of 500 Ω or greater at an operating frequency (series resonance frequency) of 1 GHz or higher.

In Examples 1 to 15, the sintered density of the multilayer part 4 was found to be 5.00 g/cm$^3$ or higher. In Examples 1 to 15, the impedance at 100 MHz (low frequency) proved to be lower than that in the high-frequency range (1 GHz).

In Comparative Examples 1 to 8 in Table 1, the composition of the ferrite powder or the content of CoO as the additive was outside of the composition range exhibited by Examples 1 to 15, while the impedance peak value frZ at the series resonance frequency fr was less than 500 Ω. In Comparative Examples 1 to 8, the sintered density of the multilayer part 4 was less than 5.00 g/cm$^3$.

In Comparative Examples 9 and 10 in Table 1, the composition of the ferrite powder was outside of the composition range exhibited by Examples 1 to 15, while the sintered density of the multilayer part 4 was less than 5.00 g/cm$^3$.

In Comparative Examples 11 to 14 in Table 2, the content of the additive CoO was outside of the composition range exhibited by Examples 1 to 15, while the impedance peak value frZ at the series resonance frequency fr was less than 500 Ω. In Comparative Examples 11 to 14, the sintered density of the multilayer part 4 was less than 5.00 g/cm$^3$.

In Comparative Examples 16 and 17 in Table 3, the composition of the ferrite powder was outside of the composition range exhibited by Examples 1 to 15, the series resonance frequency fr was less than 1 GHz, and the impedance peak value frZ was less than 500Ω.

In Comparative Example 18 in Table 3, the composition of the ferrite powder was outside of the composition range exhibited by Examples 1 to 15, while the impedance peak value frZ at the series resonance frequency fr was less than 500Ω.

In Comparative Examples 19 and 21 in Table 3, the composition of the ferrite powder was outside of the composition range exhibited by Examples 1 to 15, while the series resonance frequency ft was less than 1 GHz.

In Comparative Example 20 in Table 3, the composition of the ferrite powder was outside of the composition range exhibited by Examples 1 to 15, while the impedance peak value frZ at the series resonance frequency fr was less than 500Ω.

In Comparative Examples 22 and 23 in Table 4, the content of the additive CoO was outside of the composition range exhibited by Examples 1 to 15, while the impedance peak value frZ at the series resonance frequency fr was less than 500 Ω. In Comparative Examples 22 and 23, the impedance value at 100 MHz was 100 Ω or greater and thus was large.

In Comparative Examples 24 to 26 in Table 4, the impedance peak value frZ at the series resonance frequency fr was less than 500 Ω.

In Comparative Examples 27 to 31 in Table 4, the content of the additive CoO was outside of the composition range exhibited by Examples 1 to 15, while the series resonance frequency fr was less than 1 GHz. In Comparative Examples 29 to 31, the sintered density of the multilayer part 4 was less than 5.00 g/cm$^3$.

From the invention thus described, it will be obvious that the invention may be varied in many ways. Such variations are not to be regarded as a departure from the spirit and scope of the invention, and all such modifications as would be obvious to one skilled in the art are intended for inclusion within the scope of the following claims.

What is claimed is:

1. A multilayer inductor component comprising a multilayer part having a plurality of magnetic layers laminated therein and a conductor part arranged within the multilayer part;

wherein the magnetic layers are formed from a ferrite material and an additive;

wherein the ferrite material contains $Fe_2O_3$, NiO, CuO, and ZnO;

wherein the $Fe_2O_3$ is 30 to 45 mol %;

wherein the NiO is 45 to 58 mol %;

wherein the CuO is 6 to 10 mol %;

wherein the ZnO is 0 to 3 mol %;

wherein the additive contains CoO;

wherein the content of CoO is 0.1 to 2.5 mass % with respect to the ferrite material as a whole; and wherein the multilayer inductor component has an impedance peak of 500 Ω or greater at an operating frequency of 1 GHz or higher.

* * * * *